US006789343B1

(12) United States Patent
Dietrich et al.

(10) Patent No.: US 6,789,343 B1
(45) Date of Patent: Sep. 14, 2004

(54) AUTOMATIC CHOKE SYSTEM

(76) Inventors: James P. Dietrich, 403 S. Johnson St., New Athens, IL (US) 62264; Donald R. Hall, 2010 Fairview Ave., Belleville, IL (US) 62223

( * ) Notice: Subject to any disclaimer, the term of this patent is extended or adjusted under 35 U.S.C. 154(b) by 35 days.

(21) Appl. No.: 10/402,468

(22) Filed: Mar. 28, 2003

(51) Int. Cl.[7] ..... F41A 21/00
(52) U.S. Cl. ..... 42/79
(58) Field of Search ..... 41/79, 90

(56) References Cited

U.S. PATENT DOCUMENTS

| | | | | | |
|---|---|---|---|---|---|
| 2,700,839 | A | | 2/1955 | Finlay et al. | 42/79 |
| 2,759,286 | A | * | 8/1956 | Moore | 42/79 |
| 2,765,564 | A | * | 10/1956 | Schroeder | 42/79 |
| 2,779,119 | A | * | 1/1957 | Fawcett | 42/79 |
| 2,867,932 | A | * | 1/1959 | Keightley | 42/79 |
| 3,161,979 | A | | 12/1964 | Lowe | 42/79 |
| 3,408,762 | A | | 11/1968 | Durao | 42/79 |
| 3,797,155 | A | * | 3/1974 | Smith et al. | 42/79 |
| 3,831,306 | A | * | 8/1974 | Gregg | 42/79 |
| 4,058,925 | A | | 11/1977 | Linde et al. | 42/79 |
| 4,151,671 | A | | 5/1979 | McPeak | 42/79 |
| 4,713,904 | A | | 12/1987 | Anderson et al. | 42/79 |
| 5,452,535 | A | | 9/1995 | See et al. | 42/79 |

* cited by examiner

*Primary Examiner*—Jack Kam
*Assistant Examiner*—M. Thomson

(57) ABSTRACT

An automatic choke system for automatically adjusting the amount of choke applied to a series of shots discharged from shotgun. The automatic choke system includes a tube assembly with a plurality of longitudinal slits within the distal end thereof, a collar unit attached about the tube assembly, and a swedge assembly slidably positioned between the tube assembly and the collar unit. A latch unit attached to the collar unit selectively allows the swedge assembly to move forwardly one position after each shot fired. The latch unit is operated by gas flow from the interior of the barrel of the shotgun during a shot.

20 Claims, 12 Drawing Sheets

AUTOMATIC CHOKE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to shotgun chokes and more specifically it relates to an automatic choke system for automatically adjusting the amount of choke applied to a series of shots discharged from shotgun.

2. Description of the Related Art

Conventional shotgun chokes have been in use for years. A conventional shotgun choke is threadably secured within the distal end of a shotgun barrel. The purpose of a conventional shotgun choke is for reducing the size of the shot pattern. Shotgun owners often times have multiple chokes for usage in various situations.

The main problem with conventional shotgun chokes is that they do not provide for multiple choke settings during the operation of the shotgun. Conventional shotgun chokes are preset by the user typically by the selection of the desired choke. While the target may initially be within the shooter's ideal range for the particular choke attached, if the shooter misses the targets the targets are typically either farther or closer to the shooter thereby making the existing choke undesirable. If the targets are moving away from the shooter, a tighter choke is desired to create a smaller shot pattern. If the targets are moving towards the shooter, a looser choke is desired to create a larger shot pattern.

Another problem with conventional shotgun chokes is that they are time consuming to change because the ammunition must be removed from the shotgun, the existing choke threadably removed, the new choke threadably inserted and reload the shotgun. Another problem with conventional shotgun chokes is that the shooter typically has to purchase various sizes of chokes to accommodate their various needs which can be costly and difficult to store.

Examples of patented devices which may be related to the present invention include U.S. Pat. No. 4,713,904 to Anderson et al.; U.S. Pat. No. 4,151,671 to McPeak; U.S. Pat. No. 3,161,979 to Lowe; U.S. Pat. No. 2,700,839 to Finlay et al.; U.S. Pat. No. 3,408,762 to Durao; U.S. Pat. No. 4,058,925 to Linde et al.; and U.S. Pat. No. 5,452,535 to See et al.

While these devices may be suitable for the particular purpose to which they address, they are not as suitable for automatically adjusting the amount of choke applied to a series of shots discharged from shotgun. Conventional shotgun chokes are inefficient to utilize and do not allow the shooter to modify their choke while shooting a series of shots at a target.

In these respects, the automatic choke system according to the present invention substantially departs from the conventional concepts and designs of the prior art, and in so doing provides an apparatus primarily developed for the purpose of automatically adjusting the amount of choke applied to a series of shots discharged from shotgun.

BRIEF SUMMARY OF THE INVENTION

In view of the foregoing disadvantages inherent in the known types of shotgun chokes now present in the prior art, the present invention provides a new automatic choke system construction wherein the same can be utilized for automatically adjusting the amount of choke applied to a series of shots discharged from shotgun.

The general purpose of the present invention, which will be described subsequently in greater detail, is to provide a new automatic choke system that has many of the advantages of the shotgun chokes mentioned heretofore and many novel features that result in a new automatic choke system which is not anticipated, rendered obvious, suggested, or even implied by any of the prior art shotgun chokes, either alone or in any combination thereof.

To attain this, the present invention generally comprises a tube assembly with a plurality of longitudinal slits within the distal end thereof, a collar unit attached about the tube assembly, and a swedge assembly slidably positioned between the tube assembly and the collar unit. A latch unit attached to the collar unit selectively allows the swedge assembly to move forwardly one position after each shot fired. The latch unit is operated by gas flow from the interior of the barrel of the shotgun during a shot.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an automatic choke system that will overcome the shortcomings of the prior art devices.

A second object is to provide an automatic choke system for automatically adjusting the amount of choke applied to a series of shots discharged from shotgun.

Another object is to provide an automatic choke system that may be utilized upon various types of shotguns including semi-repeating shotguns.

An additional object is to provide an automatic choke system that is easily installed in place of a conventional choke.

A further object is to provide an automatic choke system that may be easily removed.

Another object is to provide an automatic choke system that eliminates the need to have a plurality of different choke tubes.

A further object is to provide an automatic choke system that does not obstruct the vision of the shooter.

Another object is to provide an automatic choke system can either increase or decrease the amount of choke applied to a series of shots.

A further object is to provide an automatic choke system may have various preset choke levels.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
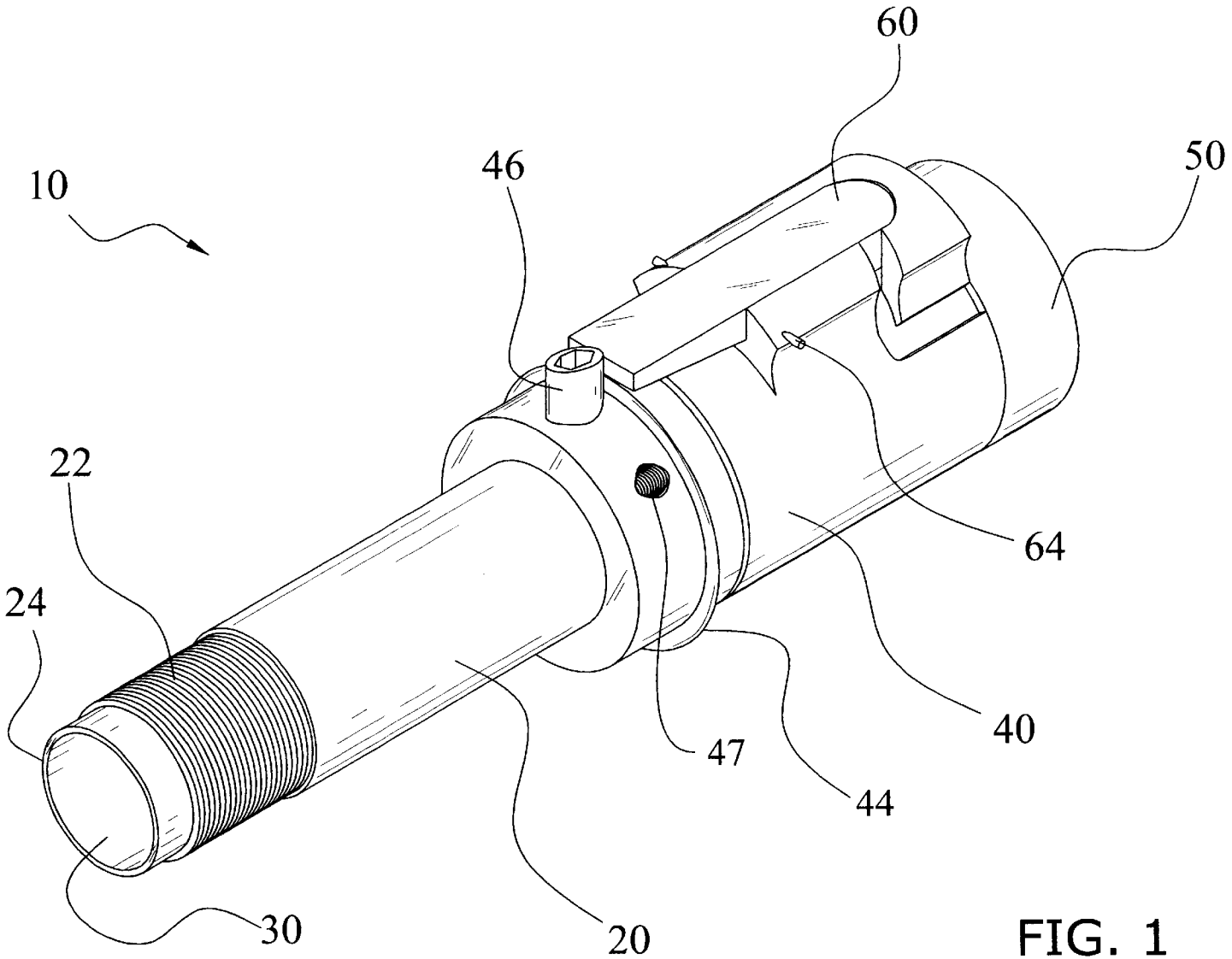
FIG. 1 is a rear upper perspective view of the present invention.
Figure 2:
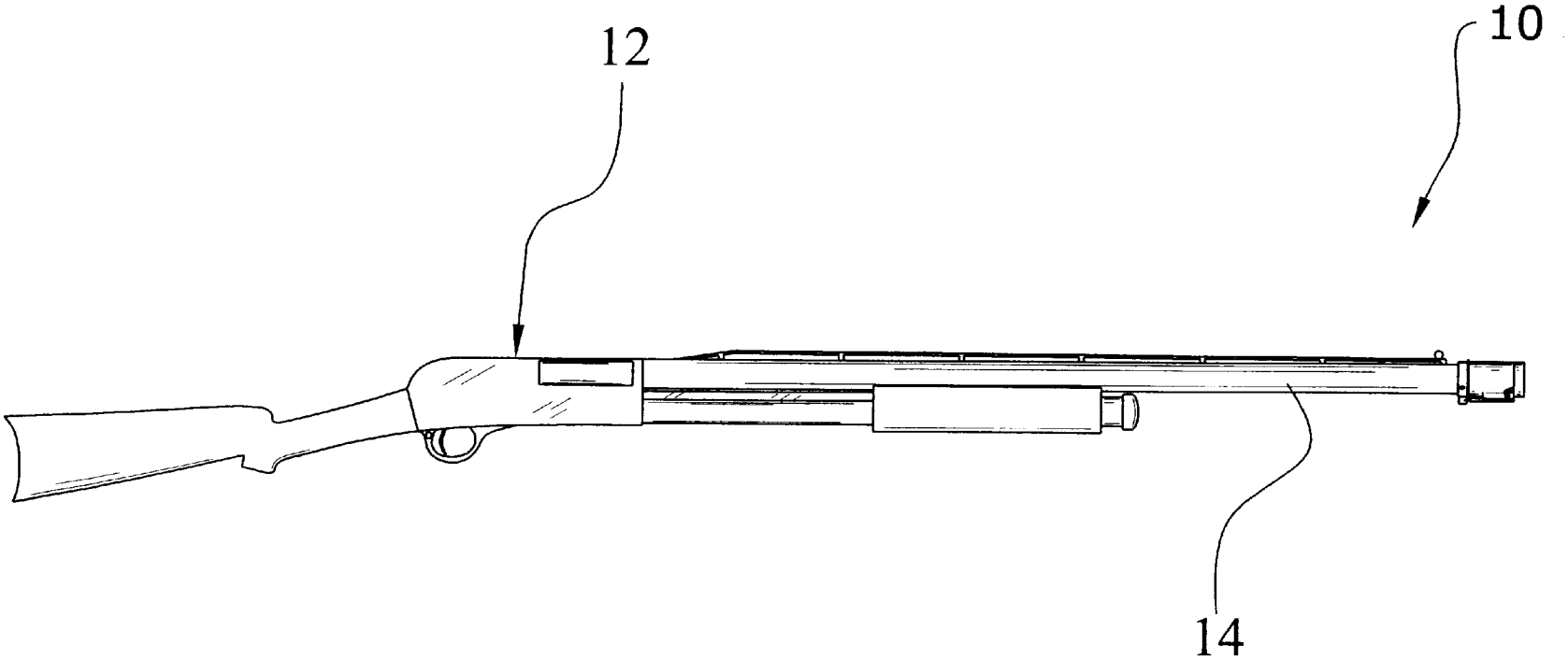
FIG. 2 is a side view of the present invention attached to a barrel of a shotgun.
Figure 3:
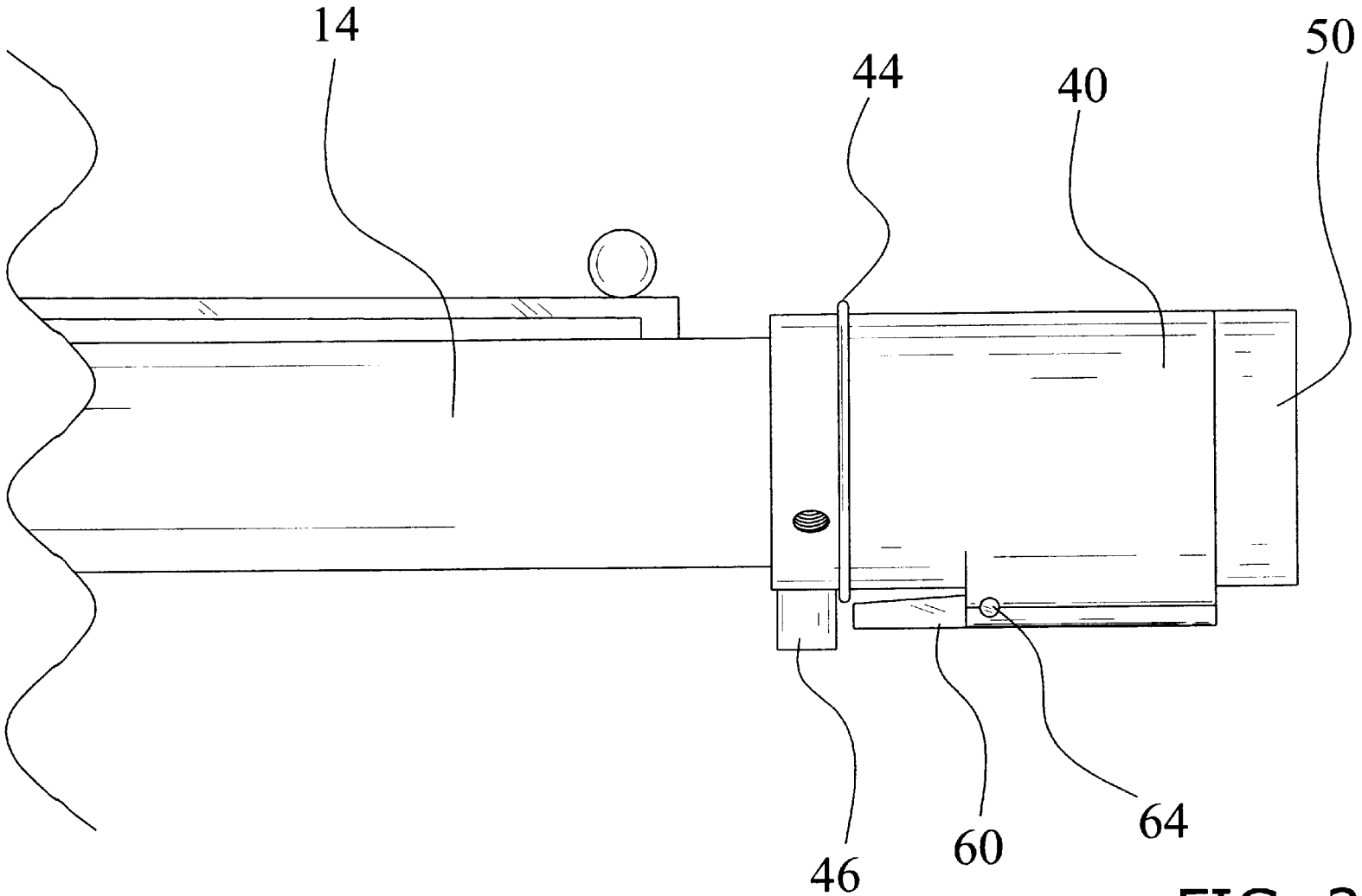
FIG. 3 is a magnified side view of the present invention attached to a barrel of a shotgun.
Figure 4:
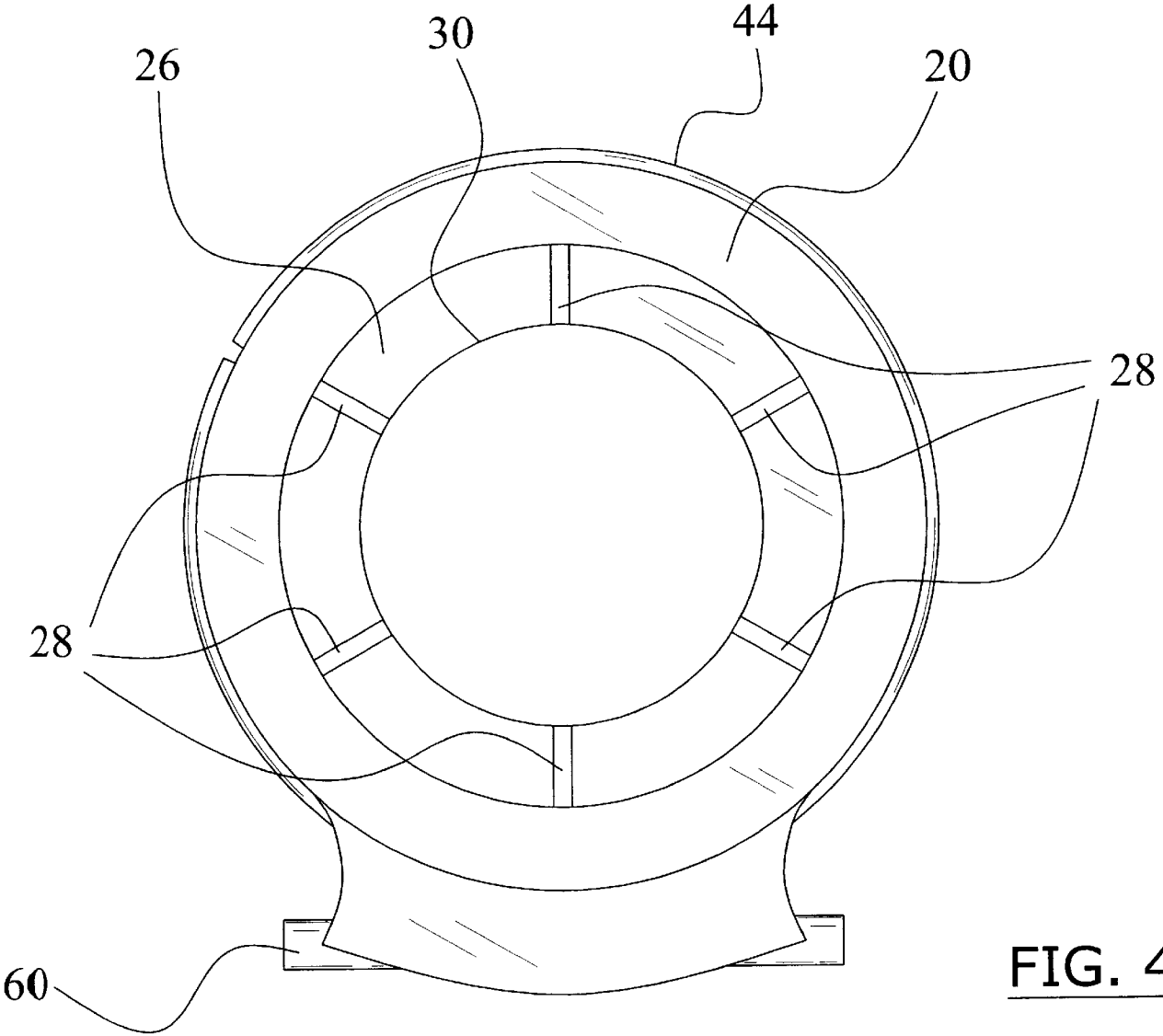
FIG. 4 is a front view of the present invention.

Turning now descriptively to the drawings, in which similar reference characters denote similar elements throughout the several views, FIGS. 1 through 12 illustrate an automatic choke system 10, which comprises a tube assembly 20 with a plurality of longitudinal slits 28 within the distal end thereof, a collar unit 40 attached about the tube assembly 20, and a swedge assembly 50 slidably positioned between the tube assembly 20 and the collar unit 40. A latch unit 60 attached to the collar unit 40 selectively allows the swedge assembly 50 to move forwardly one position after each shot fired. The latch unit 60 is operated by gas flow from the interior of the barrel 14 of the shotgun 12 during a shot.

Figure 5:
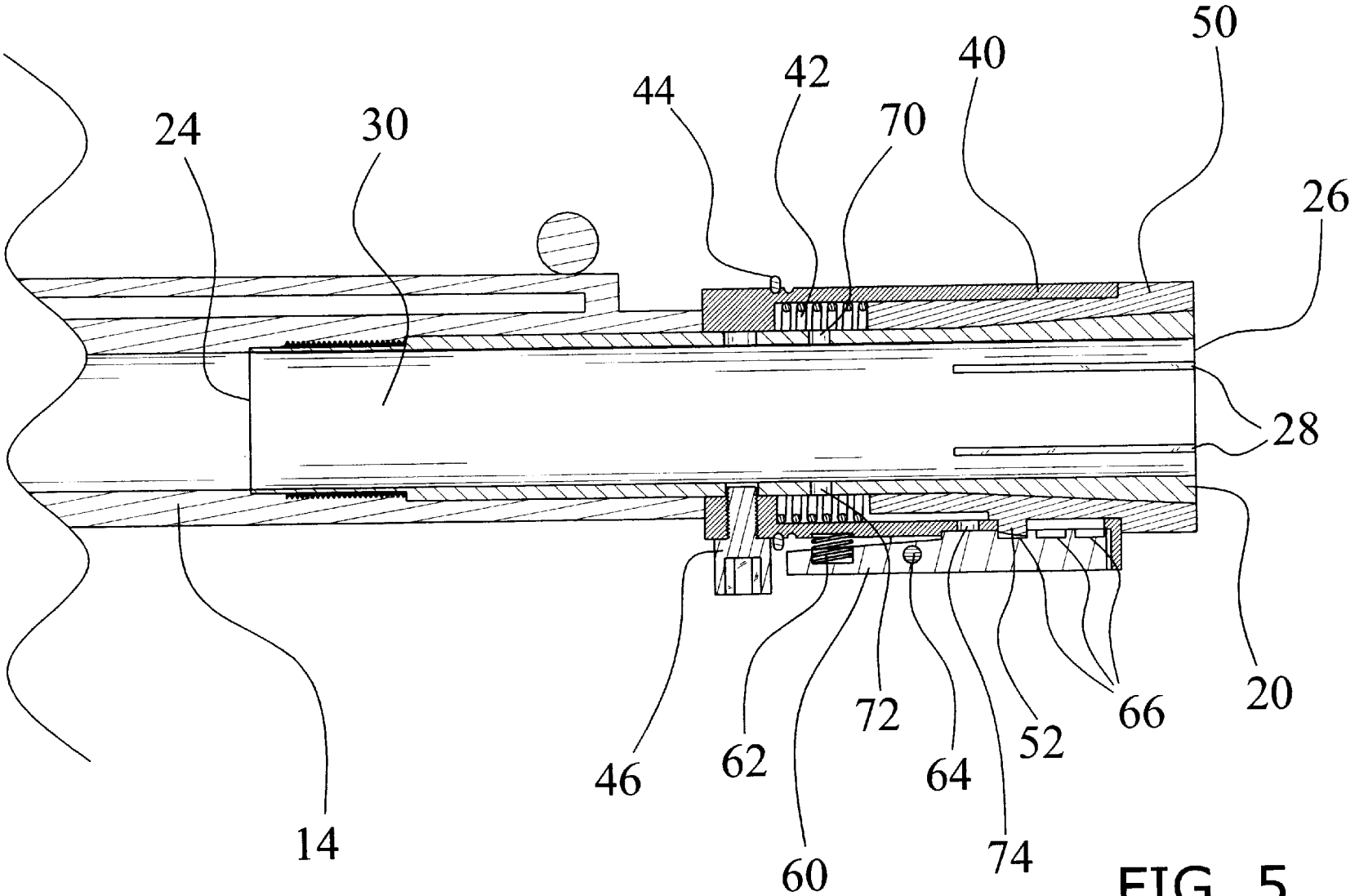
FIG. 5 is a side cutaway view of the present invention positioned within the barrel of a shotgun prior to shooting the shotgun.

The tube assembly 20 is an elongate structure having a first end 24, a second end 26 and a lumen 30. A plurality of slits 28 extend longitudinally within the second end 26 as best shown in FIG. 5 of the drawings. The first end 24 is threadably retained within a distal end of a barrel 14 of a shotgun 12 and fits within the barrel 14 similar to a conventional choke. The second end 26 of the tube assembly 20 broadens in a tapered manner as best illustrated in FIG. 5 of the drawings.

The collar unit 40 attached to the tube assembly 20 as shown in FIGS. 1 and 5 of the drawings. The collar unit 40 is preferably retained by an anchor fastener 46 or similar fastener structure. The collar unit 40 has an interior flanged structure near the rear end thereof as shown in FIG. 5 of the drawings. The anchor fastener 46 preferably extends through the interior flanged structure into a slot within the tube assembly 20 as shown in FIG. 5 of the drawings. A receiver space is defined between the collar unit 40 and the tube assembly 20 extending forwardly from the interior flanged structure as further shown in FIGS. 5 through 12 of the drawings.

The swedge assembly 50 is slidably positioned between the tube assembly 20 and the collar unit 40 as shown in FIGS. 5 through 12 of the drawings. The swedge assembly 50 has an angled interior structure corresponding to the second end 26 of the tube assembly 20 thereby allowing for the compression or expansion of the second end 26 of the tube assembly 20 depending upon the position of the swedge assembly 50 thereby creating the desired choke and shot pattern. The swedge assembly 50 preferably has a flanged end to prevent the swedge assembly 50 from extending too far into the collar unit 40 as shown in FIG. 5 of the drawings.

A spring member 42 is positioned between the collar unit 40 and the swedge assembly 50 for applying a forward force upon the swedge assembly 50 as shown in FIGS. 5 through 12 of the drawings. The spring member 42 is preferably comprised of a compression spring or other biasing structure capable of applying a consistent forward force upon the swedge assembly 50. The spring member 42 preferably surrounds the tube assembly 20 and is abutted against the interior flanged structure of the collar unit 40. The spring member 42 further engages the inner edge of the swedge assembly 50 thereby forcing the swedge assembly 50 forwardly.

The latch unit 60 is mechanically connected to the collar unit 40 for selectively retaining the swedge assembly 50 in a desired choke position prior to and during firing of the shotgun 12. The latch unit 60 releases the swedge assembly 50 to the next choke position after receiving pressurized gas from the shot.

The swedge assembly 50 includes a catch member 52 that extends through a slot within the collar unit 40 and selectively engages a plurality of receiver depressions 66 within the latch unit 60 as shown in FIG. 5 of the drawings. The latch unit 60 preferably has a first position, a second position and a third position for selectively retaining the swedge assembly 50 in three different choke positions.

Figure 12:
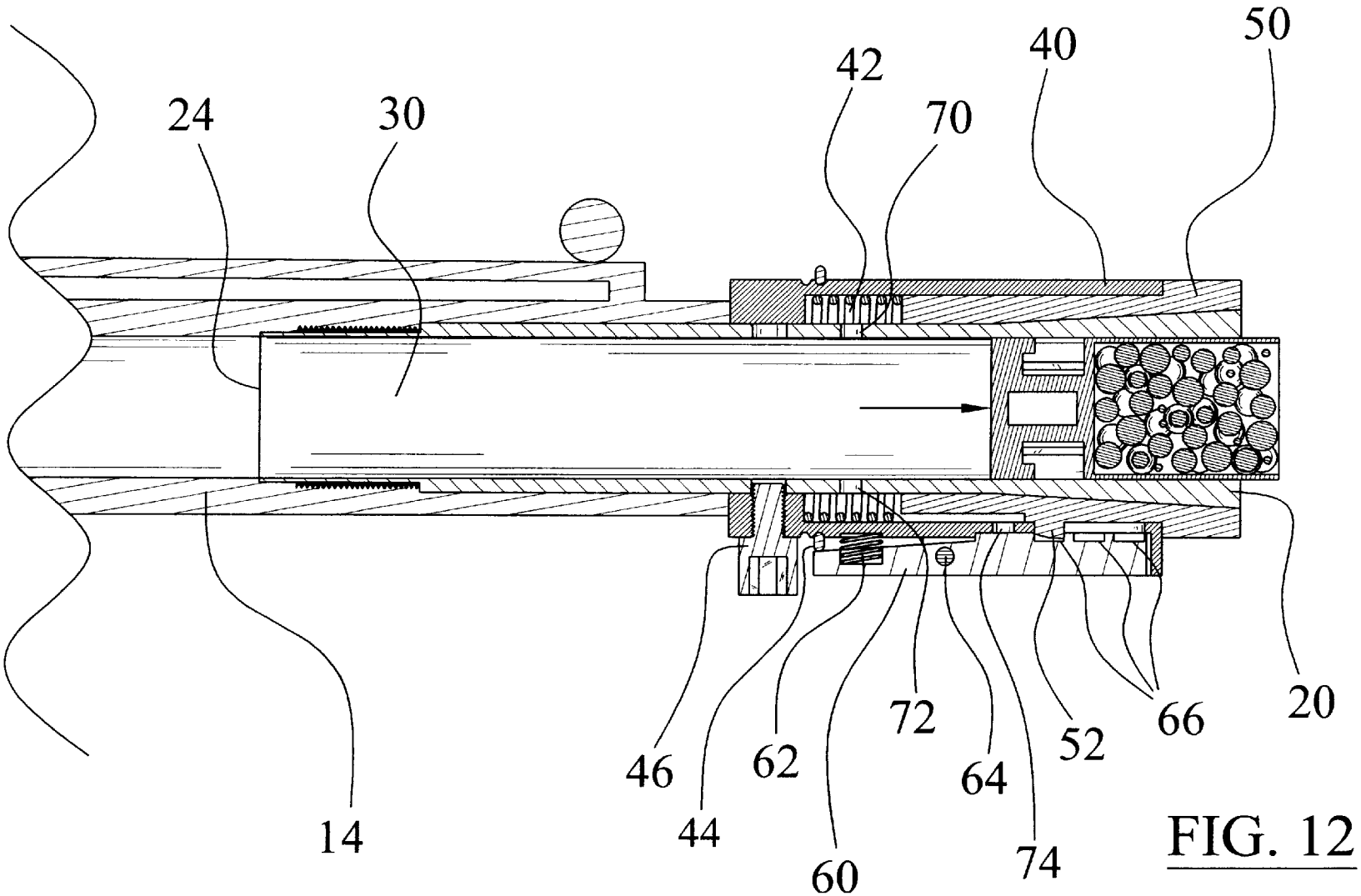
FIG. 12 is a side cutaway view of the present invention during the firing of a shot with the swedge assembly locked in the first position by the locking ring.

A locking ring 44 is movably positioned about the collar unit 40 so as to be selectively positioned beneath the latch unit 60 when the user desires to lock the swedge assembly 50 in a desired position as shown in FIGS. 1 and 12 of the drawings. The locking ring 44 may be positioned within grooves within the collar unit 40 or simply slidably positioned upon the collar unit 40. Variations of the locking ring 44 may be utilized to lock the latch unit 60 and the swedge assembly 50.

Each of the receiver depressions 66 represents a different choke position. FIG. 5 illustrates the usage of three receiver depressions 66 (i.e. three possible choke positions), but it can be appreciated that a greater or less number of receiver depressions 66 may be utilized. The rear portion of the catch member 52 is preferably angled or curved to allow the swedge assembly 50 to be manually positioned rearwardly as shown in FIG. 5 of the drawings.

The latch unit 60 is preferably comprised of a lever member pivotally attached to the collar member by a pivot pin 64 as shown in FIGS. 1 and 5 of the drawings. Pressurized gas from a shot forces the latch unit 60 to pivot outwardly thereby releasing the catch member 52. A bias spring 62 preferably attached between the latch unit 60 and the collar member for biasing the latch unit 60 as shown in FIG. 5 of the drawings.

Figure 7:
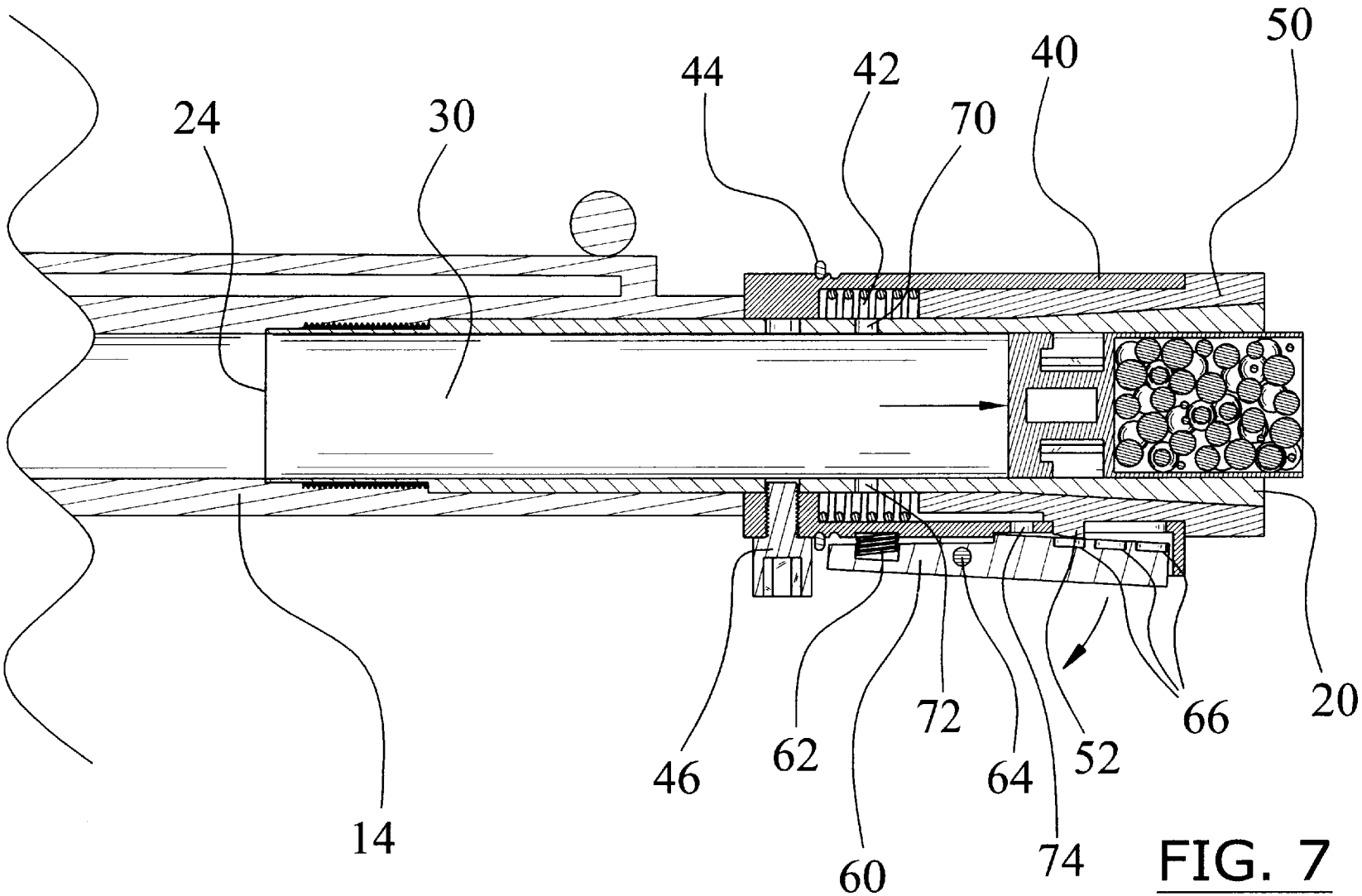
FIG. 7 is a side cutaway view of the present invention during the first shot illustrating the latch unit pivoted from the pressurized gases.

At least one gas port 70, 72 extends through the tube assembly 20 and is fluidly connected to the latch unit 60 for providing pressurized gas to the latch unit 60 during the firing of a shot. The pressurized gas is preferably transferred through the gas ports 70, 72 to the space between the collar unit 40 and the tube assembly 20 via a channel within the swedge assembly 50 to a collar port 74 within the collar unit 40. The pressurized gas is then delivered into a chamber within the latch unit 60 thereby causing the latch unit 60 to pivot outwardly when pressurized gas enters as shown in FIG. 7 of the drawings.

Figure 6:
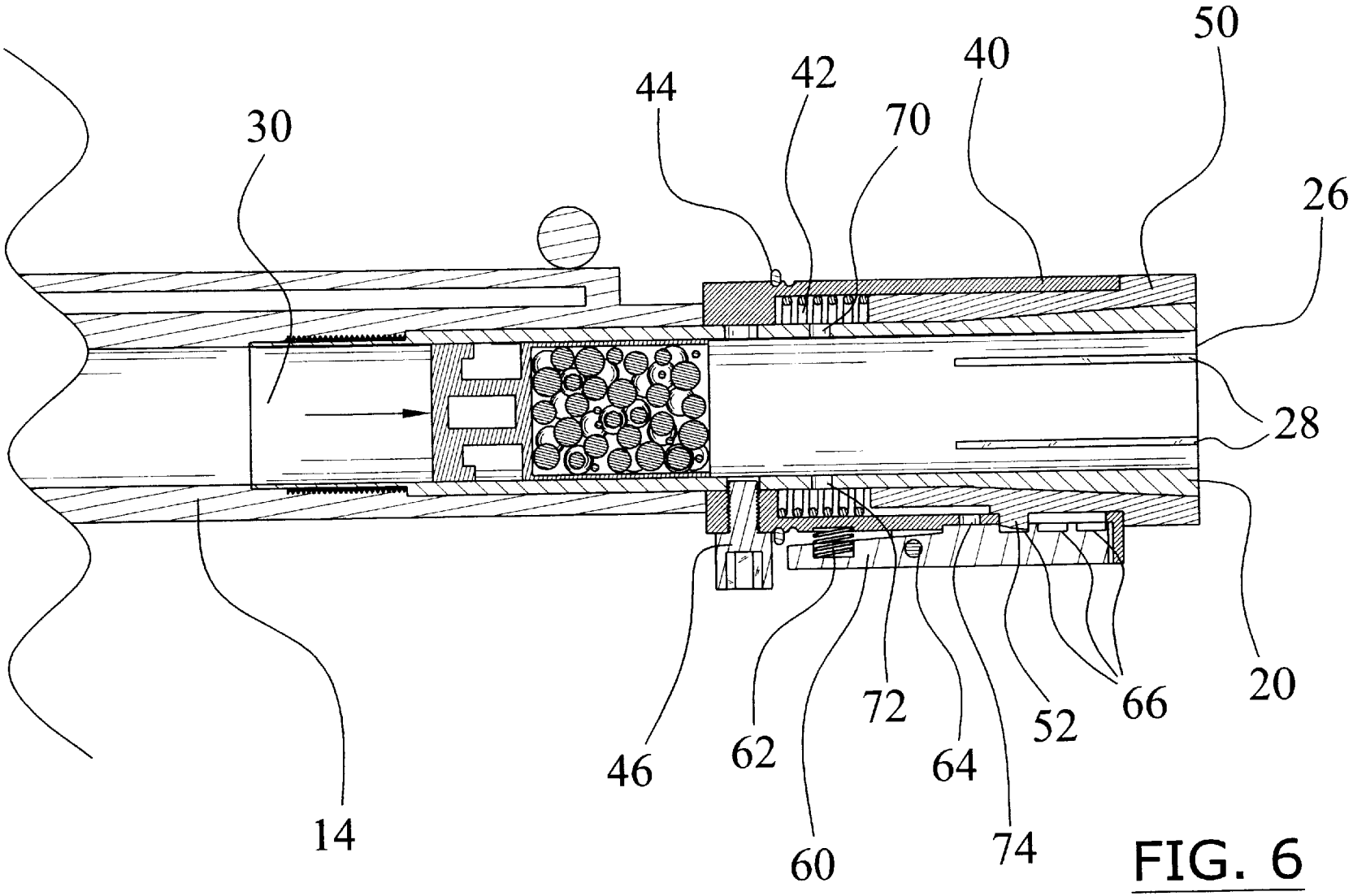
FIG. 6 is a side cutaway view of the present invention during the initial firing of a first shot with the swedge assembly in a first position.
Figure 8:
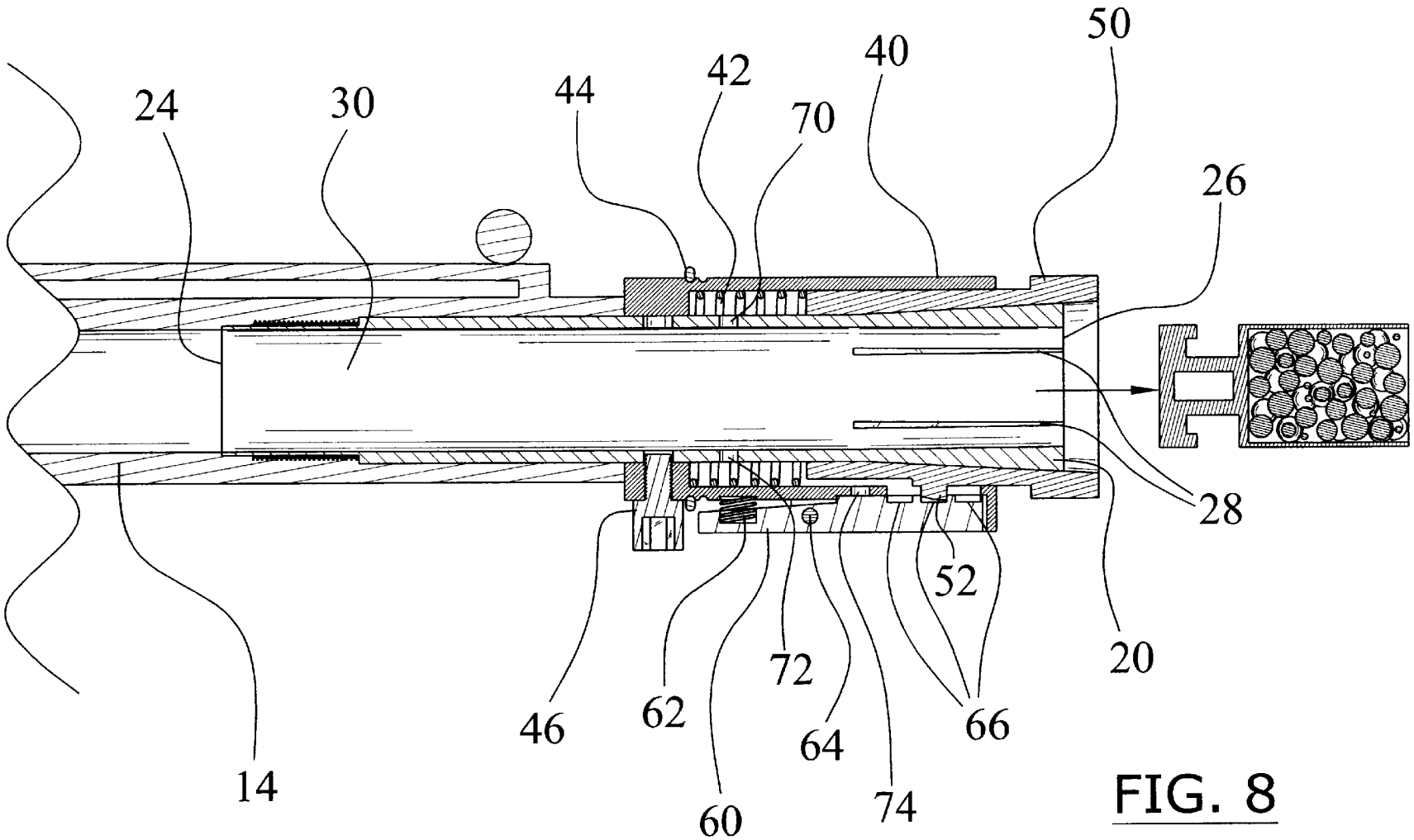
FIG. 8 is a side cutaway view of the present invention after the first shot illustrating the swedge assembly moved forwardly to a second position.
Figure 9:
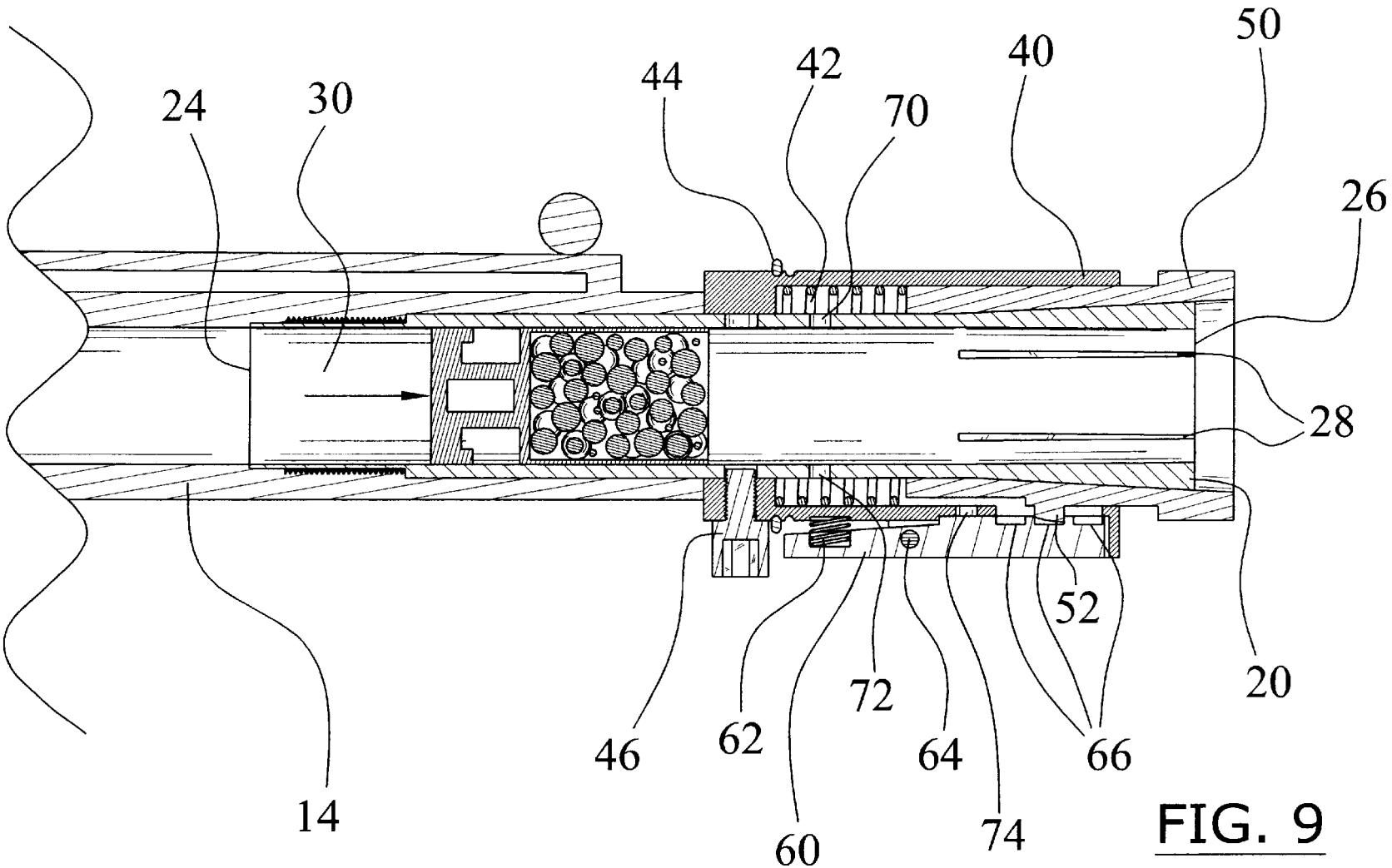
FIG. 9 is a side cutaway view of the present invention during the initial firing of a second shot with the swedge assembly in a second position.
Figure 10:
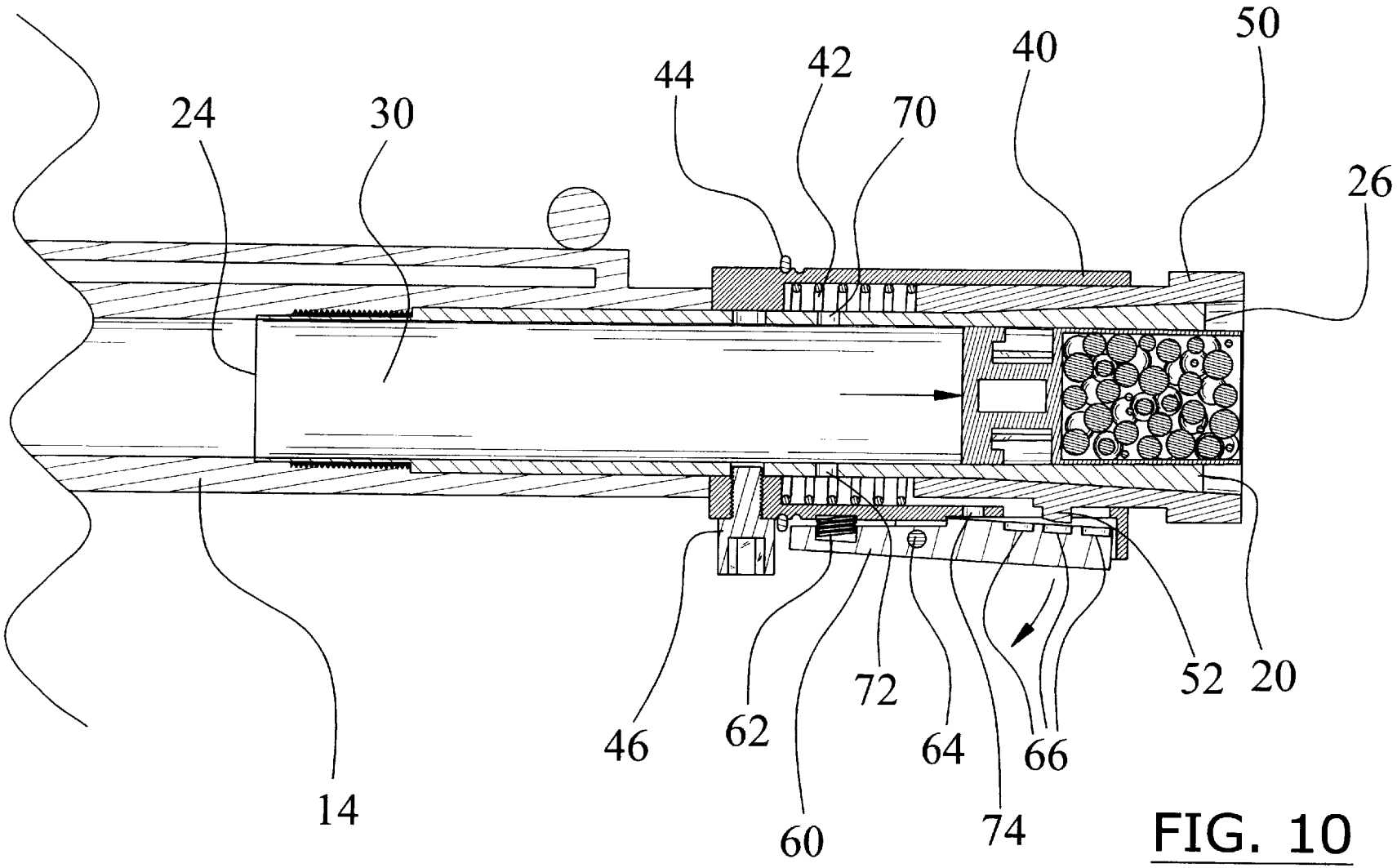
FIG. 10 is a side cutaway view of the present invention during the second shot illustrating the latch unit pivoted from the pressurized gases.
Figure 11:
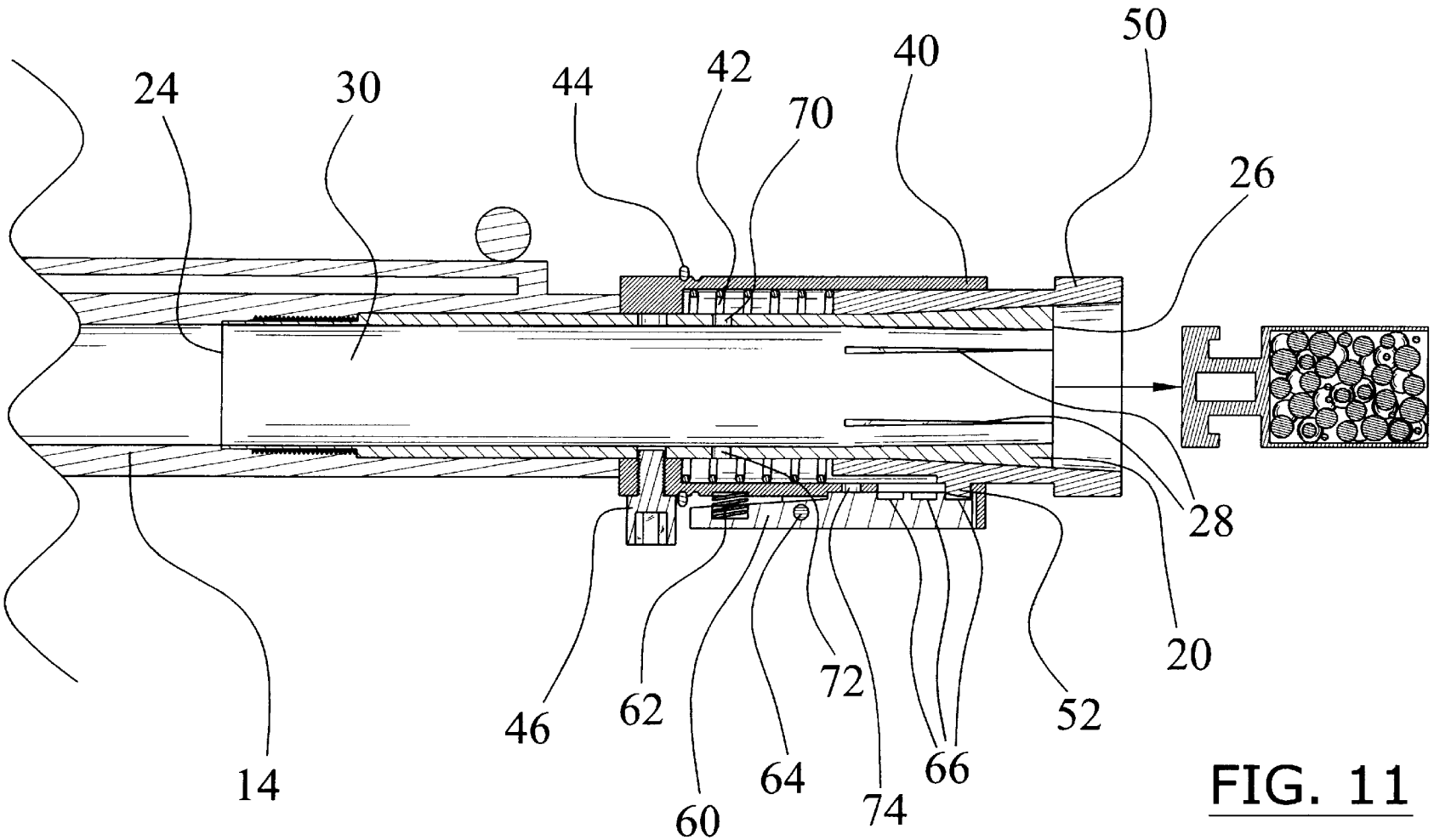
FIG. 11 is a side cutaway view of the present invention after the second shot illustrating the swedge assembly moved forwardly to a third position.

FIG. 6 illustrates the present invention during the initial firing of a first shot with the swedge assembly 50 in a first position thereby creating a relative broad shot pattern. FIG. 7 shows the present invention during the first shot illustrating the latch unit 60 pivoting outwardly from the pressurized gases received from the shot after the wad and pellets pass by the gas ports 70, 72. When the latch unit 60 pivots outwardly, the spring member 42 forces the swedge assembly 50 forwardly to the second position. FIG. 8 shows the present invention after the first shot is fired illustrating the swedge assembly 50 moved forwardly to the second position with the catch member 52 within the second receiver depression. FIG. 9 illustrates the present invention during the initial firing of a second shot with the swedge assembly 50 in the second position. FIG. 10 shows the present invention during the second shot illustrating the latch unit 60 pivoting outwardly from the pressurized gases. When the latch unit 60 pivots outwardly, the spring member 42 forces the swedge assembly 50 forwardly to the third position. FIG. 11 shows the present invention after the second shot illustrating the swedge assembly 50 moved forwardly to the third position. After the swedge assembly 50 has moved to the third position, the swedge assembly 50 will remain in the third position until the user manually forces the swedge assembly 50 back to either the first position or the second position by merely applying physical force to the distal end of the swedge assembly 50. The collar unit 40 preferably includes an extended structure that prevents the swedge assembly 50 from extending past the last position as shown in FIG. 12 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic choke system, comprising:

a tube assembly having a first end, a second end and a plurality of slits within said second end;

a collar unit attached to said tube assembly;

a swedge assembly slidably positioned between said tube assembly and said collar unit;

a spring member positioned between said collar unit and said swedge assembly for applying a forward force upon said swedge assembly;

a latch unit connected to said collar unit for selectively retaining said swedge assembly in a choke position, wherein said latch unit releases said swedge assembly to a next choke position after receiving pressurized gas; and a port extending through said tube assembly and fluidly connected to said latch unit for providing pressurized gas to said latch unit during the firing of a shot.

2. The automatic choke system of claim 1, wherein said swedge assembly includes a catch member that selectively engages a plurality of receiver depressions within said latch unit.

3. The automatic choke system of claim 2, wherein said latch unit is pivotally attached to said collar member.

4. The automatic choke system of claim 3, wherein said pressurized gas forces said latch unit to pivot thereby releasing said catch member.

5. The automatic choke system of claim 4, including a bias spring attached between said latch unit and said collar member.

6. The automatic choke system of claim 5, wherein said latch unit is a lever member.

7. The automatic choke system of claim 1, wherein said spring member is a compression spring.

8. The automatic choke system of claim 1, wherein said swedge assembly has a flanged end.

9. The automatic choke system of claim 1, wherein said latch unit has a first position, a second position and a third position for selectively retaining said swedge assembly.

10. The automatic choke system of claim 1, wherein said collar unit includes a collar port for allowing said pressurized gas to pass to said latch unit.

11. An automatic choke system, comprising:

a tube assembly having a first end, a second end and a plurality of slits within said second end, wherein said second end broadens in a tapered manner and wherein said first end is threadably retained within a distal end of a barrel of a shotgun;

a collar unit attached to said tube assembly;

a swedge assembly slidably positioned between said tube assembly and said collar unit, wherein said swedge assembly has an angled interior structure corresponding to said second end of said tube assembly;

a spring member positioned between said collar unit and said swedge assembly for applying a forward force upon said swedge assembly;

a latch unit connected to said collar unit for selectively retaining said swedge assembly in a choke position, wherein said latch unit releases said swedge assembly to a next choke position after receiving pressurized gas; and a port extending through said tube assembly and fluidly connected to said latch unit for providing pressurized gas to said latch unit during the firing of a shot.

12. The automatic choke system of claim 11, wherein said swedge assembly includes a catch member that selectively engages a plurality of receiver depressions within said latch unit.

13. The automatic choke system of claim 12, wherein said latch unit is pivotally attached to said collar member.

14. The automatic choke system of claim 13, wherein said pressurized gas forces said latch unit to pivot thereby releasing said catch member.

15. The automatic choke system of claim 14, including a bias spring attached between said latch unit and said collar member.

16. The automatic choke system of claim 15, wherein said latch unit is a lever member.

17. The automatic choke system of claim 11, wherein said spring member is a compression spring.

18. The automatic choke system of claim 11, wherein said swedge assembly has a flanged end.

19. The automatic choke system of claim 11, wherein said latch unit has a first position, a second position and a third position for selectively retaining said swedge assembly.

20. The automatic choke system of claim 11, wherein said collar unit includes a collar port for allowing said pressurized gas to pass to said latch unit.

* * * * *